US010627766B2

(12) United States Patent
Hara

(10) Patent No.: US 10,627,766 B2
(45) Date of Patent: Apr. 21, 2020

(54) IMAGE FORMING APPARATUS

(71) Applicant: KONICA MINOLTA, INC., Chiyoda-ku, Tokyo (JP)

(72) Inventor: Takahiro Hara, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/221,799

(22) Filed: Jul. 28, 2016

(65) Prior Publication Data

US 2017/0038722 A1 Feb. 9, 2017

(30) Foreign Application Priority Data

Aug. 5, 2015 (JP) ..... 2015-155230

(51) Int. Cl.
*G03G 15/00* (2006.01)
*G03G 15/20* (2006.01)

(52) U.S. Cl.
CPC ..... *G03G 15/6529* (2013.01); *G03G 15/2032* (2013.01); *G03G 15/652* (2013.01); *G03G 15/6558* (2013.01)

(58) Field of Classification Search
CPC ..... G03G 15/2067; G03G 15/1675; G03G 15/6529; G03G 15/2032; G03G 15/6517; G03G 15/652
See application file for complete search history.

(56) References Cited

U.S. PATENT DOCUMENTS 5,105,227 A 4/1992 Kitamura et al.
8,306,471 B2 11/2012 Matsuduki
2004/0074407 A1 4/2004 Iyokawa et al.
2007/0065216 A1* 3/2007 Hamaba ..... B41J 15/046 400/619
2009/0208267 A1 8/2009 Matsuduki
2011/0064468 A1* 3/2011 Kawahata ..... G03G 15/2053 399/122
2014/0064747 A1* 3/2014 Numazu ..... G03G 15/5062 399/19
2016/0259277 A1* 9/2016 Umeno ..... G03G 15/2028
(Continued)

FOREIGN PATENT DOCUMENTS

JP 63315451 A 12/1988
JP 04237075 A * 8/1992
(Continued)

OTHER PUBLICATIONS

Japanese Office Action (and English translation thereof) dated Jun. 27, 2017 issued in counterpart Japanese Application No. 2015-155230.
(Continued)

*Primary Examiner* — Judy Nguyen
*Assistant Examiner* — Quang X Nguyen
(74) *Attorney, Agent, or Firm* — Holtz, Holtz & Volek PC

(57) ABSTRACT

In an image forming apparatus, when a fixing device is in a non-fixing state and a transfer device is in a non-transfer state, an ejection device increases a conveying force by a pair of ejection rollers as compared to the conveying force in the fixing state. According to this image forming apparatus, a printing object can be stably conveyed even when a pair of rollers of the fixing device becomes separated from each other.

14 Claims, 5 Drawing Sheets

(56) References Cited

U.S. PATENT DOCUMENTS

| | | | | |
|---|---|---|---|---|
| 2016/0282775 | A1* | 9/2016 | Ui | B65H 20/02 |
| 2017/0038721 | A1 | 2/2017 | Hara | |

FOREIGN PATENT DOCUMENTS

| | | | | |
|---|---|---|---|---|
| JP | H07146625 | A | 6/1995 | |
| JP | 2000165593 | A1 * | 6/2000 | |
| JP | 2001175143 | A | 6/2001 | |
| JP | 2004291395 | A | 10/2004 | |
| JP | 2009192812 | A | 8/2009 | |
| JP | 2015158583 | A * | 9/2015 | G03G 15/2032 |

OTHER PUBLICATIONS

Japanese Office Action dated Jun. 27, 2017 (and English translation thereof) issued in Japanese Application No. 2015-155226.
Office Action (Advisory Action) dated Jul. 25, 2018 issued in U.S. Appl. No. 15/223,530.
Office Action (Final Rejection) dated Mar. 29, 2018 issued in U.S. Appl. No. 15/223,530.
Office Action (Non-Final Rejection) dated Jul. 28, 2017 issued in U.S. Appl. No. 15/223,530.
Office Action (Non-Final Rejection) dated Oct. 17, 2018 issued in U.S. Appl. No. 15/223,530.
Related U.S. Appl. No. 15/223,530; Title: "Image Forming Apparatus"; First Named Inventor: Takahiro Hara; filed Jul. 29, 2016.
Office Action (Final Rejection) dated May 3, 2019 issued in related U.S. Appl. No. 15/223,530.
Office Action (Non-Final Rejection) dated Oct. 31, 2019 issued in U.S. Appl. No. 15/223,530.

* cited by examiner

FIG.2

| | EJECTION NIP n3 | FIXING NIP n2 | TRANSFER NIP n1 | TENSION ADJUSTMENT |
|---|---|---|---|---|
| PLAIN PAPER TO HEAVY PAPER | 90N | 1000N | 90N | 50N |
| THIN PAPER | 30N | 600N | 90N | 50N |

FIG.4

| | EJECTION ROLLER | FIXING ROLLER | TRANSFER ROLLER | TENSION ADJUSTMENT |
|---|---|---|---|---|
| PLAIN PAPER TO HEAVY PAPER | 150N | SEPARATED | SEPARATED | 50N |
| THIN PAPER | 150N | SEPARATED | SEPARATED | 50N |

IMAGE FORMING APPARATUS

This application is based on Japanese Patent Application No. 2015-155230 filed with the Japan Patent Office on Aug. 5, 2015, the entire content of which is hereby incorporated by reference.

BACKGROUND OF THE INVENTION

Field of the Invention

The present invention relates to an image forming apparatus using a long printing object.

Description of the Related Art

In an image forming apparatus using a long printing object such as roll paper, continuous paper or a roll film, the straightness of the printing object is important when the printing object is conveyed. It is required to suppress the occurrence of "spoilage" of the printing object and the occurrence of "meandering" of the printing object. Japanese Laid-Open Patent Publication No. 2004-291395 discloses a technique regarding a paper feed method and apparatus including a mechanism capable of applying an optimal back tension for each paper even if the types of paper are changed.

SUMMARY OF THE INVENTION

A long printing object is conveyed by providing a pair rollers at a plurality of locations, and rotating the rollers at the plurality of locations while pinching the printing object between the pairs of rollers. A fixing device is used to fix an unfixed toner image that has been transferred onto the printing object onto the printing object.

This fixing device is also provided with a pair or rollers. A high nip pressure is applied at high temperature to the pair of rollers, due to the need to fix the unfixed toner image onto the printing object. During warm-down after the end of the printing, on the other hand, the pair of rollers is controlled such that the rollers are separated from each other for the purpose of preventing a reduction in life of the pair or rollers.

However, since the nip pressure is being applied to other pairs of rollers, it is required to stably convey the printing object even when the pair of rollers of the fixing device becomes separated from each other. That is, even when the pair of rollers of the fixing device becomes separated from each other, the nip pressures need to be balanced among the pairs of rollers so as to stably convey the printing object.

The present invention has been made in view of the aforementioned problem, and an object of the invention is to provide an image forming apparatus capable of stably conveying a printing object even when a pair of rollers of a fixing device becomes separated from each other.

To achieve at least one of the abovementioned objects, an image forming apparatus reflecting one aspect of the present invention is an image forming apparatus that forms an image on a long printing object while conveying the printing object, including: a transfer device including a pair of transfer rollers forming a transfer nip that transfers an unfixed toner image onto the printing object; a fixing device disposed downstream of the transfer device in a direction in which the printing object is conveyed, the fixing device including a pair of fixing rollers forming a fixing nip that fixes the unfixed toner image that has been transferred onto the printing object onto the printing object; a tension adjustment device disposed upstream of the transfer device in the direction in which the printing object is conveyed, the tension adjustment device applying a prescribed tension to the printing object; and an ejection device disposed downstream of the fixing device in the direction in which the printing object is conveyed, the ejection device including a pair of ejection rollers forming an ejection nip that ejects the printing object.

The fixing device is configured such that a selection can be made between a fixing state in which the printing object is conveyed while a prescribed nip pressure is applied to the fixing nip, and the unfixed toner image that has been transferred onto the printing object is successively fixed onto the printing object, and a non-fixing state in which the pair of fixing rollers is separated from each other and no nip pressure is applied to the fixing nip.

The transfer device is configured such that a selection can be made between a transfer state in which the printing object is conveyed while a prescribed nip pressure is applied to the transfer nip, when the fixing state is selected for the fixing device, and a non-transfer state in which the pair of transfer rollers is separated from each other and no nip pressure is applied to the transfer nip, when the non-fixing state is selected for the fixing device.

When the fixing device is in the non-fixing state and the transfer device is in the non-transfer state, the ejection device increases a conveying force by the pair of ejection rollers as compared to the conveying force in the fixing state.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a first diagram showing relation among nip pressures in regions in the image forming apparatus shown in FIG. 1.

FIG. 4 is a second diagram showing relation among the nip pressures in the regions in the image forming apparatus shown in FIG. 3.

DESCRIPTION OF THE PREFERRED EMBODIMENTS

An image forming apparatus in an embodiment based on the present invention will be described below with reference to the drawings. When a number, an amount or the like is mentioned in the embodiment described below, the scope of the present invention is not necessarily limited to the number, the amount or the like unless otherwise specified. The same or corresponding components are designated by the same reference numbers and redundant description may not be repeated. In addition, it is originally intended to appropriately combine and use configurations in the embodiment.

In addition, a long printing object for use in the image forming apparatus of this embodiment means roll paper, continuous paper, a roll film (polypropylene, polyethylene terephthalate) or the like, but also includes any other printing object that can be used for this type of image forming apparatus.

(General Configuration of Image Forming Apparatus 1000)

Figure 1:
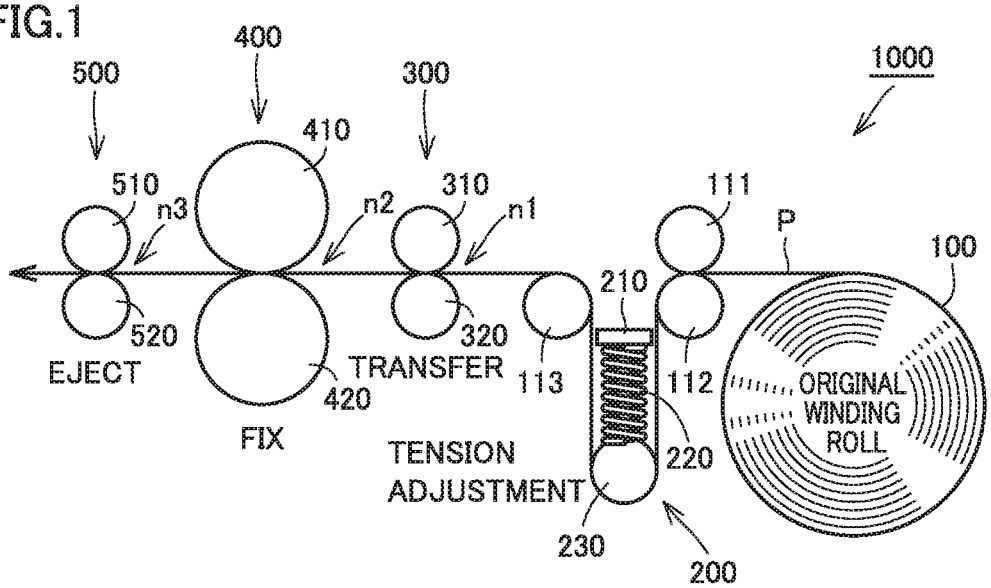
FIG. 1 is a first diagram showing an overall configuration of an image forming apparatus of an embodiment.

FIG. 1 is a diagram (first diagram) showing an overall configuration of an image forming apparatus 1000 in this embodiment.

This image forming apparatus 1000 forms an image on a long printing object P while conveying this printing object P. Image forming apparatus 1000 roughly includes a paper feed unit, a transfer unit, a fixing unit, and a paper ejection unit. The paper feed unit includes an original winding roll 100 with long printing object P wound therearound as a roll, a pair of conveying guide rollers 111, 112 to convey and guide printing object P pulled out from original winding roll 100, a tension adjustment device 200 to adjust the tension on conveyed printing object P, and a conveying guide roller 113 to convey and guide printing object P.

Tension adjustment device 200 includes an ascending/descending plate 210, a tension adjustment spring 220, and a tension roller 230. By raising or lowering the position of ascending/descending plate 210 by a not-shown drive mechanism, the tension on printing object P can be adjusted steplessly.

The transfer unit is disposed downstream of the paper feed unit in a direction in which printing object P is conveyed, and includes a transfer device 300 including a pair of transfer rollers 310, 320 forming a transfer nip n1 that transfers an unfixed toner image onto printing object P.

The fixing unit is disposed downstream of transfer device 300 in the direction in which printing object P is conveyed, and includes a fixing device 400 including a pair of fixing rollers 410, 420 forming a fixing nip n2 that fixes the unfixed toner image that has been transferred onto printing object P onto printing object P.

This fixing device 400 is configured such that a selection can be made between a fixing state in which printing object P is conveyed while a prescribed nip pressure is applied to fixing nip n2, and the unfixed toner image that has been transferred onto printing object P is successively fixed onto printing object P, and a non-fixing state in which the pair of fixing rollers 410, 420 is separated from each other and no nip pressure is applied to fixing nip n2.

Transfer device 300 is configured such that a selection can be made between a transfer state in which printing object P is conveyed while a prescribed nip pressure is applied to transfer nip n1, when the fixing state is selected for fixing device 400, and a non-transfer state in which the pair of transfer rollers 310, 320 is separated from each other and no nip pressure is applied to transfer nip n1, when the non-fixing state is selected for fixing device 400.

The paper ejection unit is disposed downstream of fixing device 400 in the direction in which printing object P is conveyed, and includes an ejection device 500 including a pair of ejection rollers 510, 520 forming an ejection nip n3 that ejects printing object P.

In image forming apparatus 1000 having the configuration described above, in a normal operating condition of transferring an image onto printing object P, transfer rollers 310, 320, fixing rollers 410, 420, and ejection rollers 510, 520 are driven to convey printing object P. In this case, to prevent the occurrence of "sagging" of printing object P among the rollers, a conveying speed at each roller is set so as to satisfy ejection rollers 510, 520≥fixing rollers 410, 420≥transfer rollers 310, 320.

In addition, the nip pressure at each roller is provided such that, as shown in FIG. 2, when plain paper or heavy paper is used, fixing nip n2 has a nip pressure of 1000 N so as to satisfy the fixing property, whereas transfer nip n1 and ejection nip n3 each have a nip pressure of 90 N.

A conveying force F at each nip is obtained as F=friction force (μ)×nip pressure. In this embodiment, the friction force (μ) is 0.5, for example, and conveying force F applied to printing object P is such that F=500 N at fixing nip n2 and F=45 N at transfer nip n1 and ejection nip n3.

It is desirable that the nip pressure of ejection nip n3 be high so as to prevent wrapping around fixing rollers 410, 420. If it is too high relative to the nip pressure of fixing nip n2, however, printing object P slips at fixing nip n2, resulting in a poor image such as uneven gloss in the toner image. Thus, the conveying force based on the nip pressures as shown in FIG. 2 is employed.

When thin paper (including a resin film) is used as printing object P, on the other hand, as shown in FIG. 2, the nip pressure of fixing nip n2 is reduced to 600 N so that an excessive amount of heat is not provided to printing object P. Accordingly, the nip pressure of ejection nip n3 is reduced to 30 N to prevent the occurrence of a slip during the fixing. The nip pressure of transfer nip n1 is likewise reduced to 30 N.

In this manner, when the nip pressure of fixing nip n2 is adjusted depending on the thickness of printing object P during the operation of pressure fixing by fixing device 400, the nip pressures of ejection nip n3 and transfer nip n1 should be reduced according to the change in fixing nip n2, to adjust the conveying force.

Tension adjustment device 200 needs to create a high tension for stably conveying printing object P without meandering, and is adjusted to generate a tension of 50 N upstream of transfer device 300. This 50 N is a value required during the printing so as to prevent poor accuracy of the position of the image due to meandering.

Here, fixing rollers 410, 420 of fixing device 400 are warmed up (hereinafter referred to as "WU") before secondary transfer, and are warmed down (hereinafter referred to as "WD") after the secondary transfer. During the "WU" and "WD", it is desirable to not rotate fixing rollers 410, 420 to minimize the occurrence of "spoilage" of printing object P. If completely stopped, however, fixing rollers 410, 420 are elevated in temperature, which may result in damage to fixing rollers 410, 420 such as partial melting.

Thus, during the "WU" and "WD", fixing rollers 410, 420 are rotated at a very low speed of 5 mm/s, the lower limit at which fixing rollers 410, 420 are not melted, and fixing rollers 410, 420 are separated from each other to prevent transmission of additional heat.

In addition, during the "WU" and "WD", transfer rollers 310, 320 of transfer device 300 are also separated from each other to avoid deterioration of the expensive transfer rollers and belt.

Figure 3:
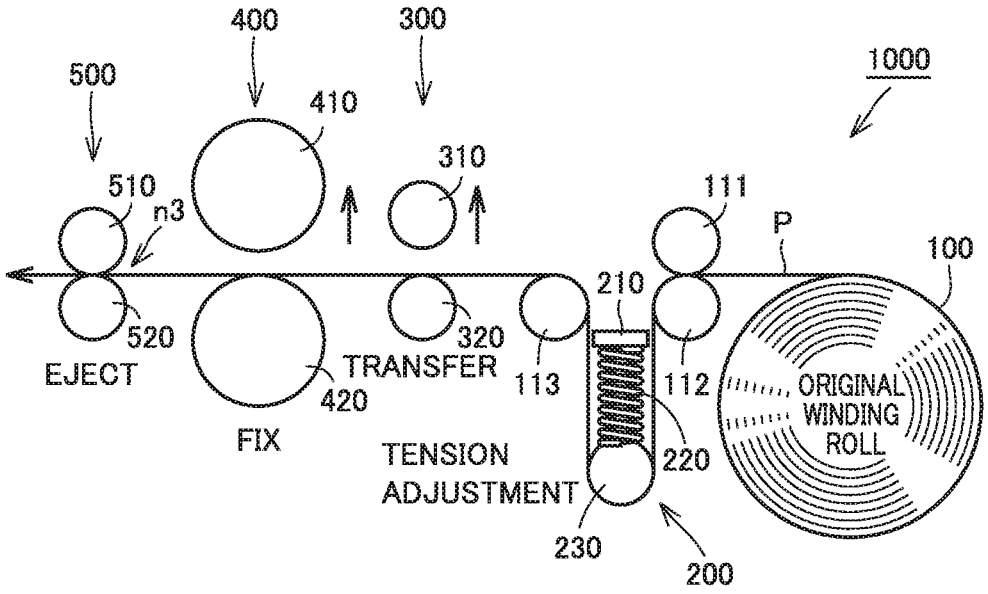
FIG. 3 is a second diagram showing the overall configuration of the image forming apparatus of the embodiment.

As shown in FIG. 3, when fixing device 400 is in the non-fixing state and transfer device 300 is in the non-transfer state, namely, when transfer rollers 310, 320 and fixing rollers 410, 420 are separated from each other, printing object P is conveyed only by ejection rollers 510, 520 having a small conveying force. In this case, ejection nip n3 has a nip pressure of 90 N or 30 N, as described above.

At the paper feed unit side, on the other hand, a tension of 50 N has been generated by tension adjustment device 200. Thus, with a conveying force based on this relation between the nip pressure of ejection nip n3 and the tension by tension adjustment device 200, printing object P slips without being conveyed.

Thus, in this embodiment, during the "WU" and "WD" when transfer rollers 310, 320 and fixing rollers 410, 420 are separated from each other, the nip pressure of ejection nip n3 is increased to 150 N as shown in FIG. 4 to increase the conveying force, so as to prevent the occurrence of the aforementioned slip of printing object P.

Here, when ejection nip n3 of ejection rollers 510, 520 has a nip pressure of 150 N, the tension applied to printing object P results from a friction force of ejection rollers 510, 520 on printing object P. In this embodiment, the friction force (μ) is 0.5, and conveying force F applied to printing object P is 75 N, which is obtained as friction force (μ)×nip pressure.

Accordingly, even when fixing device 400 is during the "WU" and "WD", the conveying force by ejection rollers 510, 520 is greater than the tension by tension adjustment device 200, thereby preventing the occurrence of a slip of printing object P and allowing printing object P to be stably conveyed.

Figure 5:
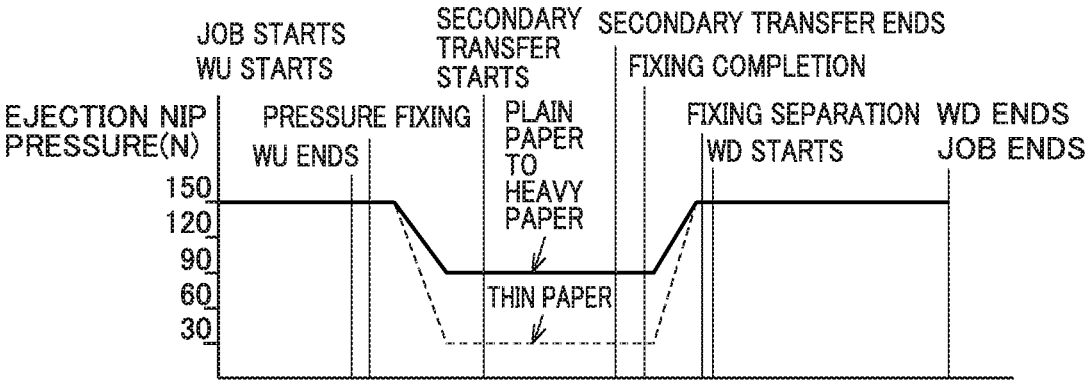
FIG. 5 is a diagram illustrating a time chart of tension adjustment in the image forming apparatus of the embodiment.

Referring now to FIG. 5, a time chart of tension adjustment in image forming apparatus 1000 of this embodiment is described. FIG. 5 is a diagram illustrating a time chart of tension adjustment in image forming apparatus 1000.

In FIG. 5, a solid line indicates the nip pressure of ejection nip n3 when plain paper or heavy paper is used, whereas a dotted line indicates the nip pressure of ejection nip n3 when thin paper is used. Transfer takes place between "secondary transfer starts" and "(final image rear edge) fixing completion," with the "WU" and "WD" of fixing device 400 being performed therebefore and thereafter, respectively. Namely, the "WU" and "WD" is performed while fixing rollers 410, 420 are separated from each other.

Regarding "fixing separation" before fixing device 400 makes a transition to the "WD", fixing rollers 410, 420 should be separated from each other after the nip pressure of ejection nip n3 is increased, to prevent the occurrence of a slip of printing object P due to insufficient conveying force. For the same reason, after the end of the "WU", the pressure fixing by fixing rollers 410, 420 should be started before the nip pressure of ejection nip n3 starts to be reduced.

To prevent a slip of fixing nip n2 which causes a poor image such as uneven gloss, the nip pressure of ejection nip n3 should be started to be increased after a rearmost edge of the toner image on printing object P passes through fixing nip n2.

As described above, according to the image forming apparatus, when fixing device 400 is in the non-fixing state and transfer device 300 is in the non-transfer state, ejection device 500 increases the conveying force by the pair of ejection rollers 510, 520 as compared to the conveying force in the fixing state.

Thus, when fixing rollers 410, 420 are separated from each other so as to prevent damage to fixing rollers 410, 420 and printing object P is conveyed by ejection rollers 510, 520 during the "WU" and "WD" of fixing device 400, the conveying force by ejection rollers 510, 520 is reduced so as to avoid pulling against fixing rollers 410, 420 during the printing.

During the fixing by fixing device 400, on the other hand, a high tension is needed for printing object P so as to stably convey printing object P, and a conveying force strong enough to overcome the tension can be provided.

Although the embodiments of the present invention have been described, it should be understood that the embodiments disclosed herein are illustrative and non-restrictive in every respect. The scope of the present invention is defined by the terms of the claims, and is intended to include any modifications within the scope and meaning equivalent to the terms of the claims.

What is claimed is:

1. An image forming apparatus that forms an image on a long printing object while conveying the printing object, comprising:

a transfer device including a pair of transfer rollers forming a transfer nip that transfers an unfixed toner image onto the printing object;

a fixing device disposed downstream of the transfer device in a direction in which the printing object is conveyed, the fixing device including a pair of fixing rollers forming a fixing nip that fixes the unfixed toner image that has been transferred onto the printing object onto the printing object;

a tension adjustment device disposed upstream of the transfer device in the direction in which the printing object is conveyed, the tension adjustment device applying a prescribed tension to the printing object;

an ejection device disposed downstream of the fixing device in the direction in which the printing object is conveyed, the ejection device including a pair of ejection rollers forming an ejection nip that ejects the printing object; and a controller, wherein:

the controller controls the fixing device to be switched between (i) a fixing state in which the printing object is conveyed while a prescribed nip pressure is applied to the fixing nip, and the unfixed toner image that has been transferred onto the printing object is successively fixed onto the printing object, and (ii) a non-fixing state in which the pair of fixing rollers are separated from each other and no nip pressure is applied to the fixing nip, the controller controls the transfer device to be switched between (i) a transfer state in which the printing object is conveyed while a prescribed nip pressure is applied to the transfer nip, when the fixing device is in the fixing state, and (ii) a non-transfer state in which the pair of transfer rollers are separated from each other and no nip pressure is applied to the transfer nip, when the fixing device is in the non-fixing state, and in response to the fixing device being in the non-fixing state and the transfer device being in the non-transfer state, the controller controls the ejection device to increase a nip pressure at the ejection nip to thereby increase a conveying force for conveying the printing object in a direction in which the printing object is ejected by the pair of ejection rollers as compared to the conveying force in the fixing state.

2. The image forming apparatus according to claim 1, wherein the controller controls the ejection device to increase the conveying force by the ejection rollers before the pair of fixing rollers are separated from each other.

3. The image forming apparatus according to claim 1, wherein after pressure fixing of the toner image by the fixing rollers ends, the controller controls the ejection device to start to reduce the conveying force by the ejection rollers.

4. The image forming apparatus according to claim 1, wherein after a rearmost edge of the toner image on the printing object passes through the fixing nip, the controller controls the ejection device to start to increase the conveying force by the ejection rollers.

5. The image forming apparatus according to claim 1, wherein warm-up and warm-down of the fixing device is performed while the fixing rollers are separated from each other.

6. The image forming apparatus according to claim 1, wherein the controller controls the fixing rollers and the ejection rollers such that, when the nip pressure of the fixing nip is adjusted by the pair of fixing rollers, the conveying force by the ejection rollers is also adjusted according to the change in the nip pressure of the fixing nip.

7. The image forming apparatus according to claim 1, wherein the conveying force by the pair of ejection rollers is obtained as a product of a friction force and the nip pressure at the ejection nip.

8. The image forming apparatus according to claim 1, wherein conveyance of the printing object continues when the conveying force by the pair of ejection rollers is increased.

9. The image forming apparatus according to claim 1, wherein the tension adjustment device comprises a movable plate, a tension adjustment spring, and a tension roller.

10. The image forming apparatus according to claim 9, wherein the tension roller contacts with the printing object and displaces the printing object from only one side thereof in a direction orthogonal to the direction in which the printing object is conveyed.

11. The image forming apparatus according to claim 1, wherein the prescribed tension applied to the printing object by the tension adjustment device is adjustable.

12. The image forming apparatus according to claim 1, wherein the tension adjustment device applies the prescribed tension onto the printing object by contacting with and displacing the printing object from only one side thereof in a direction orthogonal to the direction in which the printing object is conveyed.

13. The image forming apparatus according to claim 1, wherein the printing object is a long continuous printing object.

14. The image forming apparatus according to claim 13, wherein the controller controls to adjust the nip pressure applied to the fixing nip when the fixing device is in the fixing state and the nip pressure applied to the transfer nip when the transfer device is in the transfer state based on a type of the long continuous printing object.

* * * * *